United States Patent [19]

Lengemann et al.

[11] Patent Number: 4,859,313

[45] Date of Patent: Aug. 22, 1989

[54] METHOD FOR REDUCING THE TEMPERATURE IN A REGENERATION ZONE OF A FLUID CATALYTIC CRACKING PROCESS

[75] Inventors: Robert A. Lengemann, Arlington Heights; Gregory J. Thompson, Waukegan; Anthony G. Vickers, Arlington Heights; Raymond W. Mott, Darien, all of Ill.

[73] Assignee: UOP Inc., Des Plaines, Ill.

[21] Appl. No.: 896,569

[22] Filed: Aug. 15, 1986

Related U.S. Application Data

[63] Continuation of Ser. No. 703,625, Feb. 20, 1985, abandoned.

[51] Int. Cl.[4] ..... C10G 11/00; C10G 35/00

[52] U.S. Cl. ..... 208/113; 208/120; 208/126; 208/149; 208/156; 208/164

[58] Field of Search ..... 208/74, 88, 55, 149, 208/156, 120, 164, 126, 113; 502/38, 41

[56] References Cited

U.S. PATENT DOCUMENTS

| | | | |
|---|---|---|---|
| 2,446,247 | 8/1948 | Scherneman | 208/55 |
| 2,472,723 | 6/1949 | Peet | 196/50 |
| 2,723,223 | 11/1955 | Nicholson | 195/52 |
| 2,819,951 | 1/1958 | Medlin et al. | 23/288 |
| 2,889,269 | 6/1959 | Nicholson | 208/149 |
| 2,894,902 | 7/1959 | Nicholson | 208/149 |
| 2,906,703 | 9/1959 | Dalla Valle | 208/149 |
| 3,990,992 | 11/1976 | McKinney | 252/417 |
| 4,211,637 | 7/1980 | Gross et al. | 208/164 |
| 4,219,442 | 8/1980 | Vickers | 252/417 |
| 4,234,411 | 11/1980 | Thompson | 208/74 |
| 4,243,514 | 1/1981 | Bartholic | 208/91 |
| 4,257,875 | 3/1981 | Lengemann et al. | 208/113 |
| 4,289,605 | 9/1981 | Bartholic | 208/113 |
| 4,650,564 | 3/1987 | Occdli et al. | 208/113 |

FOREIGN PATENT DOCUMENTS

| | | |
|---|---|---|
| 2116062 | 11/1982 | United Kingdom . |
| 2116202 | 11/1982 | United Kingdom . |

*Primary Examiner*—H. M. S. Sneed
*Assistant Examiner*—Chung K. Pak
*Attorney, Agent, or Firm*—Thomas K. McBride; John G. Tolomei; John G. Cutts, Jr.

[57] ABSTRACT

A method for operating a fluid catalytic cracking unit comprising a regeneration zone and a reaction zone with a relatively reduced temperature in the regeneration zone while processing a hydrocarbon feedstock having a 50 volume percent distillation temperature greater than about 500° F. which method comprises contacting the feedstock in a reaction zone with a mixture of regenerated fluidizable cracking catalyst and fluidizable low coke make solid particles comprising a refractory inorganic oxide in a ratio of low coke make solid particles to cracking catalyst from about 1:100 to about 10:1, the low coke made solid particles having a surface area of less than about 5 $m^2/g$ and a coke making capability of less than about 0.2 weight percent coke on the spent low coke make solid particles in the ASTM standard method for testing cracking catalyst by microactivity test (MAT); separating the resulting vaporized hydrocarbon products from the mixture of deactivated fluidizable cracking catalyst and fluidizable low coke made solid particles; recovering the resulting vaporized hydrocarbon products; passing the mixture of cracking catalyst and low coke made solid particles to the regeneration zone for regeneration by removal of coke; and passing the resulting regenerated mixture of cracking catalyst and low coke make solid particles from the regeneration zone to the reaction zone to contact the feedstock as described above whereby the regeneration zone temperature is maintained at a reduced temperature as compared to an equivalent operation without the use of the fluidizable low coke make solid particles while simultaneously not affecting the operation of the reaction zone.

20 Claims, 1 Drawing Sheet

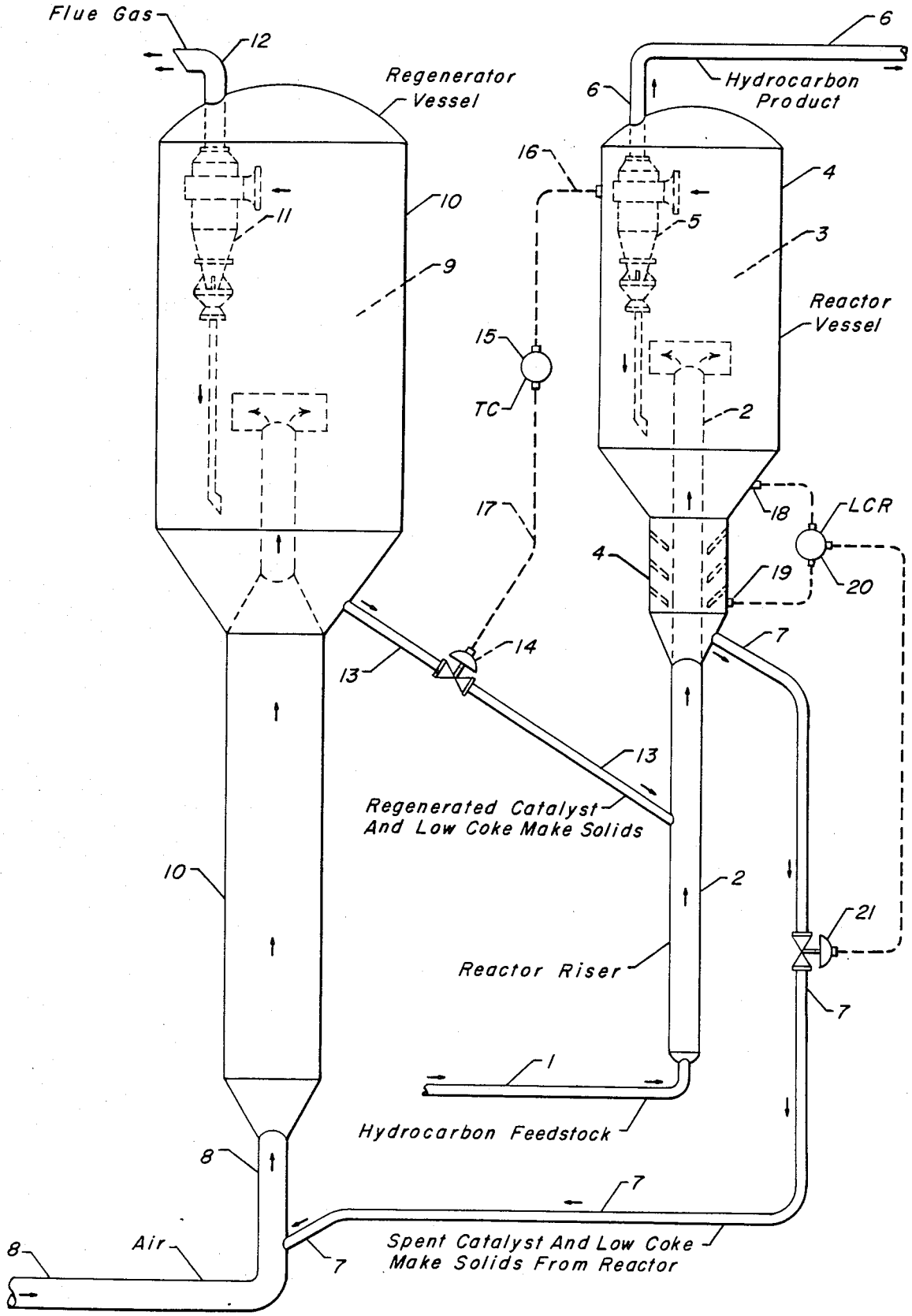
Flue Gas
12
Regenerator Vessel
10
11
9
6
Hydrocarbon Product
16
4
5
3
Reactor Vessel
15
TC
2
17
18
LCR
4
19
20
7
14
13
13
Regenerated Catalyst And Low Coke Make Solids
10
2
21
Reactor Riser
7
1
Hydrocarbon Feedstock
8
7
8
Air
7
Spent Catalyst And Low Coke Make Solids From Reactor

METHOD FOR REDUCING THE TEMPERATURE IN A REGENERATION ZONE OF A FLUID CATALYTIC CRACKING PROCESS

This application is a continuation of application Ser. No. 703,625, filed Feb. 20, 1985, now abandoned.

BACKGROUND OF THE INVENTION

The field of art to which this invention pertains is the reduction of the temperature in the regeneration zone of a fluid catalytic cracking process. More specifically, the invention relates to reducing the maximum temperature reached in the regeneration zone of a fluid catalytic cracking process without reducing the amount of coke burned therein by simultaneously circulating, in admixture with cracking catalyst, fluidizable low coke make solid particles which have a surface area of less than about 5 $m^2/g$ and which low coke make solid particles generate less than about 0.2 weight percent coke on the spent low coke make solid particles in the ASTM standard method for testing fluid cracking catalyst by microactivity test (MAT) in an amount sufficient to result in a ratio of low coke make solid particles to cracking catalyst from about 1:100 to about 10:1, thereby lowering the regenerator temperature from about 10° F. to about 250° while simultaneously not affecting the operation of the reaction zone.

INFORMATION DISCLOSURE

In U.S. Pat. No. 2,472,723 (Peet), a method is disclosed for converting residual hydrocarbon feedstock in a fluid catalytic cracking system embodying a reaction and a regeneration zone wherein the feedstock is firstly contacted with clay and then the resulting clay and hydrocarbon admixture is contacted with catalyst under hydrocarbon conversion conditions. The particle size of the clay is selected so that substantially all of the clay passes through the catalytic unit on a once-through basis without entering the regeneration zone. Therefore, the '723 patent does not contemplate the regeneration and subseqeunt recycle of the clay or low coke make solid particles to the fresh hydrocarbon feedstock.

In U.S. Pat. No. 2,723,223 (Nicholson), a method is disclosed for converting residual hydrocarbon feestock which comprises contacting the hydrocarbon with finely divided expendable solid catalyst and a relatively coarse, catalytically inert solid particles and thereafter withdrawing, heating in a regeneration zone and recycling at least a portion of the inert solids. Therefore, since an expendable solid catalyst is used, the '223 patent does not teach the regeneration and recycle of catalyst.

Another patent, U.S. Pat. No. 2,906,703 (Dalla Valle), claims a method for converting residual hydrocarbon feedstock wherein the feedstock is contacted with a finely divided fluidizable catalyst and subsequently the admixture of catalyst and hydrocarbon is upwardly passed through a fluidized bed of relatively larger inert solid particles. The inert solid particles are removed from the system if desired and the '703 patent does not teach the regeneration and recycle of inerts or low coke make solid particles to the fluidized bed.

In U.S. Pat. Nos. 2,889,269 (Nicholson) and 2,894,902 (Nicholson), methods are taught wherein finely divided catalyst and inert, fluidizable heat transfer solid particles are circulated through a fluidized reactor-regenerator system for the purpose of removing heat from the regenerator. These methods are used primarily in conjunction with the fluid hydroforming of naphtha. The '269 patent and the '902 patent do not disclose or teach the use of fluidizable low coke make solid particles having a surface area of less than about 5 $m^2/g$ and a coke making capability of less than about 0.2 weight percent coke on the spent low coke make solid particles in the ASTM standard method for testing cracking catalyst by microactivity test (MAT) in a fluid catalytic cracking process whereby the regeneration zone temperature is maintained at a reduced temperature while simultaneously not affecting the operation of the reaction zone.

In U.S. Pat. No. 4,243,514 (Bartholic), a process is disclosed for contacting residual hydrocarbon feedstock in a hydrocarbon decarbonizing zone with an inert fluidizable solid material. The carbonized inert solids are transported to a burning zone for carbon removal and the resulting inert solids are recycled to the hydrocarbon decarbonizing zone. The '514 patent does not teach contacting the residual hydrocarbon feedstock with an admixture of inert or low coke make solids and catalyst and subsequently regenerating and recycling the admixture of inert or low coke make solids and catalyst.

In U.S. Pat. No. 4,257,875 (Lengemann et al.), a fluid catalytic process is disclosed for the conversion of residual hydrocarbon feedstocks wherein a split flow of catalyst is passed to the reactor riser. The '875 patent does not disclose or claim the use of low coke make solids and the subsequent regeneration and recycle of the low coke make solids.

In U.S. Pat. No. 4,234,411 (Thompson), a fluid catalytic process is disclosed for the conversion of residual hydrocarbon feedstock wherein a split flow of catalyst is passed to the reactor riser and which flows are controlled in a manner responsive to temperatures within the reactor riser and reactor vessel. The '411 patent does not disclose or claim the use of low coke make solids and the subsequent regeneration and recycle of the low coke make solids.

In U.S. Pat. No. 4,289,605 (Bartholic), a fluid catalytic cracking process is disclosed whereby a metal-containing hydrocarbon charge stock is contacted with an admixture of active cracking catalyst and inert porous solid particles. Preferred inert porous solid particles are characterized by having at least 50% of the pore volume comprising pores of at least 100 Angstroms in diameter and having a surface area of about 10 to 15 square meters per gram. A preferred type of inert porous solid particles is calcined kaolin clay. The primary purpose of the large pore inert solid is to selectively accept the large molecules characteristic of metal and Conradson Carbon content of the charge. The '605 patent does not disclose or claim the circulation of low coke make solid particles which have a surface area of less than about 5 $m^2/g$ and generate less than about 0.2 weight percent coke on the spent low coke make solid particles in the ASTM standard method for testing cracking catalysts by microactivity test (MAT) for reducing the regeneration zone temperature while simultaneously not affecting the operation of the reaction zone.

In British Pat. No. 2,116,062 (Occelli et al.), a catalytic cracking composition comprising a solid cracking catalyst and a diluent containing a selected alumina or a selected alumina in combination with one or more heat-stable inorganic compounds wherein the aluminaceous diluent has a surface area of 30–1000 $m^2/g$ and a pore volume of 0.05–2.5 cc/gram is disclosed. The primary purpose of the high surface area diluent is to permit the catalyst system to function well even when the catalyst carries a substantially high level of metal on its surface. The '062 patent does not disclose or claim the circulation of low coke make solid particles which have a surface area of less than about 5 $m^2/g$ and generate less than about 0.2 weight percent coke on the spent low coke make solid particles in the ASTM standard method for testing cracking catalysts by microactivity test (MAT) for reducing the regeneration zone temperature while simultaneously not affecting the operation of the reaction zone.

In British Pat. No. 2,116,202 (Occelli et al.), a fluid catalytic cracking process is disclosed whereby a high metals content charge stock is contacted with a catalyst composition comprising a cracking catalyst having high activity and a diluent selected from the group consisting of alumina and alumina in combination with a heat-stable metal compound wherein the diluent possesses a surface area of about 30 to about 1000 $m^2$/gram and a pore volume of 0.05–2.5 cc/gram. The fluid catalytic cracking process as described in the '202 patent is useful for the processing of high metal content charge stock. The '202 patent does not disclose or claim the circulation of low coke make solid particles which have a surface area of less than about 5 $m^2/g$ and generate less than about 0.2 weight percent coke on the spent low coke make solid particles in the ASTM standard method for testing cracking catalysts by microactivity test (MAT) for reducing the regeneration zone temperature while simultaneously not affecting the operation of the reaction zone.

A common prior art method of heat removal provides coolant filled coils within the regenerator, which coils are in contact with the catalyst from which coke is being removed. For example, Medlin et al. U.S. Pat. No. 2,819,951, McKinney U.S. Pat. No. 3,990,992 and Vickers U.S. Pat. No. 4,219,442 disclose fluid catalytic cracking processes using dual zone regenerators with cooling coils mounted in the second zone. These cooling coils must always be filled with coolant and thus be removing heat from the regenerator, even during start-up when such removal is particularly undesired, because the typical metallurgy of the coils is such that the coils would be damaged by exposure to the high regenerator temperature (up to 1350° F.) without coolant serving to keep them relatively cool. Furthermore, the cooling coils necessarily reduce the temperature of the regenerated catalyst which is circulated to the reaction zone. Therefore, in order to maintain a constant reaction zone temperature, additional catalyst must be circulated which in turn produces more coke thereby further reducing the yield of valuable liquid products.

The present invention is a method for reducing the temperature in the regeneration zone of a fluid catalytic cracking process by the circulation of low coke make solid particles which have a surface area of less than about 5 $m^2/g$, and generate less than about 0.2 weight percent coke on the spent low coke make solid particles in the ASTM standard method for testing cracking catalysts by microactivity test (MAT).

BRIEF SUMMARY OF THE INVENTION

One embodiment of the present invention relates to a method for operating a fluid catalytic cracking unit comprising a regeneration zone and a reaction zone with a relatively reduced temperature in the regeneration zone while processing a hydrocarbon feedstock having a 50 volume percent distillation temperature greater than about 500° F. which method comprises contacting the feedstock in a reaction zone with a mixture of regenerated fluidizable cracking catalyst and fluidizable low coke make solid particles comprising a refractory inorganic oxide in a ratio of low coke make solid particles to cracking catalyst from about 1:100 to about 10:1, the low coke make solid particles having a surface area of less than about 5 $m^2/g$ and a coke making capability of less than about 0.2 weight percent coke on the spent low coke make solid particles in the ASTM standard method for testing cracking catalyst by microactivity test (MAT); separating the resulting vaporized hydrocarbon products from the mixture of deactivated fluidizable cracking catalyst and fluidizable low coke make solid particles; recovering the resulting vaporized hydrocarbon products; passing the mixture of cracking catalyst and low coke make solid particles to the regeneration zone for regeneration by removal of coke; and passing the resulting regenerated mixture of cracking catalyst and low coke make solid particles from the regeneration zone to the reaction zone to contact the feedstock as described above whereby the regeneration zone temperature is maintained at a reduced temperature as compared to an equivalent operation without the use of the fluidizable low coke make solid particles while simultaneously not affecting the operation of the reaction zone.

Another embodiment of the present invention relates to a process for catalytic cracking of a hydrocarbon feedstock having a 50 volume percent distillation temperature greater than about 500° F. by contacting the feedstock at cracking temperature with a circulating, particle form, solid cracking catalyst whereby components of the feedstock are converted to lower boiling hydrocarbons in a reaction zone with concurrent deposition on the catalyst of a deactivating carbonaceous contaminant, regenerating the catalytic cracking activity of the contaminated catalyst by burning carbonaceous deposits therefrom in a regeneration zone and under conditions that would otherwise result in the regeneration zone reaching an unacceptable or undesired maximum temperature condition, circulating catalyst so regenerated from the regeneration zone to the reaction zone, wherein the improvement comprises reducing the maximum temperature reached in the regeneration zone without reducing the amount of coke burned therein by simultaneously circulating, in admixture with the cracking catalyst, fluidizable low coke make solid particles which comprise a refractory inorganic oxide and have a surface area of less than about 5 $m^2/g$ and which low coke make solid particles generate less than about 0.2 weight percent coke on the spent low coke make solid particles in the ASTM standard method for testing fluid cracking catalysts by microactivity test (MAT) in an amount sufficient to result in a ratio of low coke make solid particles to cracking catalyst from about 1:100 to about 10:1, thereby lowering the regeneration temperature from about 10° F. to about 250° F. while simultaneously not affecting the operation of the reaction zone.

Other embodiments of the present invention encompass further details such as feedstock descriptions, catalyst and low coke make solid characteristics, and operating conditions, all of which are hereinafter disclosed in the following discussion of each of these facets of the invention.

BRIEF DESCRIPTION OF THE DRAWING

The drawing illustrates a preferred embodiment of the present invention and is an elevational view of apparatus suitable for use in accordance with the present invention. Other types of apparatus may also be suitable for use with the present invention.

DETAILED DESCRIPTION OF THE INVENTION

The fluid catalyst cracking process (hereinafter FCC) has been extensively relied upon for the conversion of starting materials, such as vacuum gas oils, and other relatively heavy oils, into lighter and more valuable products. FCC involves the contact in a reaction zone of the starting material, whether it be vacuum gas oil or another oil, with a finely divided, or particulated, solid, catalytic material which behaves as a fluid when mixed with a gas or vapor. This material possesses the ability to catalyze the cracking reaction, and in so acting it is surfacedeposited with coke, a by-product of the cracking reaction. Coke is comprised of hydrogen, carbon and other material such as sulfur, and it interferes with the catalytic activity of FCC catalysts. Facilities for the removal of coke from FCC catalyst, so called regeneration facilities or regenerators, are ordinarily provided within an FCC unit. Regenerators contact the coke-contaminated catalyst with an oxygen containing gas at conditions such that the coke is oxidized and a considerable amount of heat is released. A portion of this heat escapes the regenerator with the flue gas, comprised of excess regeneration gas and the gaseous products of coke oxidation, and the balance of the heat leaves the regenerator with the regenerated, or relatively coke free, catalyst. Regenerators operating at superatmospheric pressures are often fitted with energy-recovery turbines which expand the flue gas as it escapes from the regenerator and recover a portion of the energy liberated in the expansion.

The fluidized catalyst is continuously circulated from the reaction zone to the regeneration zone and then again to the reaction zone. The fluid catalyst, as well as providing catalytic action, acts as a vehicle for the transfer of heat from zone to zone. Catalyst exiting the reaction zone is spoken of as being "spent", that is, partially deactivated by the deposition of coke upon the catalyst. Catalyst from which coke has been substantially removed is spoken of as "regenerated catalyst".

The rate of conversion of the feedstock within the reaction zone is controlled by regulation of the temperature, activity of catalyst and quantity of catalyst (i.e., catalyst to oil ratio) therein. The most common method of regulating the temperature is by regulating the rate of circulation of catalyst from the regeneration zone to the reaction zone which simultaneously increases the catalyst/oil ratio. That is to say, if it is desired to increase the conversion rate, an increase in the rate of flow of circulating fluid catalyst from the regenerator to the reactor is effected. Inasmuch as the temperature within the regeneration zone under normal operations is considerably higher than the temperature within the reaction zone, this increase in influx of catalyst from the hotter regeneration zone to the cooler reaction zone effects an increase in reaction zone temperature.

Recently, politico-economic restraints which have been put upon the traditional lines of supply of crude oil have made necessary the use, as starting materials in FCC units, of heavier-than-normal oils. FCC units must now cope with feedstocks such as residual oils and in the future may require the use of mixtures of heavy petroleum oils with coal or shale derived oils.

The chemical nature and molecular structure of the feed to the FCC unit will affect the level of coke on spent catalyst. Generally speaking, the higher the molecular weight, the higher the Conradson carbon, the higher the heptane insolubles, and the higher the carbon to hydrogen ratio, the higher will be the coke level on the spent catalyst. Also, high levels of combined nitrogen, such as found in shale derived oils, will also increase the coke level on spent catalyst. The processing of heavier and heavier feedstocks, and particularly the processing of deasphalted oils, or direct processing of atmospheric bottoms from a crude unit, commonly referred to as reduced crude, does cause an increase in all of some of these factors and does therefore cause an increase in coke level on spent catalyst.

This increase in coke on spent catalyst results in a larger amount of coke burned in the regenerator per pound of catalyst circulated. Heat is removed from the regenerator in conventional FCC units in the flue gas and principally in the hot regenerated catalyst stream. An increase in the level of coke on spent catalyst will increase the temperature in the regenerator. However, there are limitations to the temperatures that can be tolerated by FCC catalyst without there being a substantial detrimental effect on catalyst activity. Generally, with commonly available modern FCC catalyst, temperatures of regenerated catalyst are usually maintained below 1400° F., since loss of activity would be very severe above about 1400°–1450° F.

In order to burn a greater amount of coke in the regeneration zone and yet maintain a maximum temperature below about 1400° F., the prior art has extensively taught the use of cooling coils installed in or in communication with the regeneration zone. Cooling coils which are associated with FCC regeneration zones must necessarily be constantly charged with a cooling medium and are considered to be a vulnerable link in the overall FCC process.

Objectives of the present invention are to reduce the temperature of the regeneration zone and to transfer heat from the regeneration zone to the reaction zone while simultaneously not affecting the operation of the reaction zone.

We have discovered a method for reducing the temperature in a regeneration zone of a fluid catalytic cracking process wherein a combination of catalyst and low coke make solid particles of fluidizable particle size is contacted with the hydrocarbon feedstock and subsequently both the catalyst and the low coke make solid particles are regenerated and recycled.

We have discovered that it is highly desirable to circulate catalyst particles which contribute to the cracking of the feed by virtue of their catalytic cracking activity but which produce coke on their surface as by-product of this process with another class of particles which exhibit very little tendency to produce coke. The important performance criteria for selection of the latter class of particle for use with the present invention is the ability to not contribute significantly to the formation of additional coke on the mixture of low coke make solid particles and catalyst particles above the level of coke which would have been deposited on the catalyst particles had they been present in the reaction environment alone. This latter class of particles will herein be referred to as low coke make solid particles.

The present invention provides a process for the continuous catalytic conversion of a wide variety of hydrocarbon oils to lower molecular weight products, while maximizing production of highly valuable liquid products, and making it possible, if desired, to avoid vacuum distillation and other expensive treatments such as hydrotreating. Preferred feedstocks for the present invention include residual hydrocarbon oil or any other hydrocarbon feedstock having a 50 volume percent distillation temperature greater than about 500° F. The term "residual hydrocarbon oil" includes not only those predominantly hydrocarbon compositions which are liquid at room temperature, but also those predominantly hydrocarbon compositions which are asphalts or tars at ambient temperature but liquefy when heated to temperatures in the range of up to about 800° F. or more. Suitable feedstocks for use in the present invention are residual oils whether of petroleum origin or not. For example, the invention may be applied to the processing of such widely diverse materials as heavy bottoms from crude oil, heavy bitumen crude oil, those crude oils known as "heavy crude" which approximate the properties of reduced crude, shale oil, tar sand extract, products from coal liquefaction and solvated coal, atmospheric and vacuum reduced crude, extract and/or bottoms from solvent de-asphalting, aromatic extract from lube oil refining, tar bottoms, heavy cycle oil, slop oil, other refinery waste streams and mixtures thereof. Such mixtures can for instance be prepared by mixing available hydrocarbon fractions, including oils, tar, pitches and the like. Likewise, the invention may be applied to hydrotreated feedstocks, but it is an advantage of the invention that it can successfully convert residual oils which have had no prior hydrotreatment. However, a preferred application of the process is the treatment of reduced crude, i.e., that fraction of crude oil boiling at and above 650° F., alone or in admixture with virgin gas oils. While the use of material, that has been subjected to prior vacuum distillation is not excluded, it is an advantage of the invention that it can satisfactorily process feedstock which has had no prior vacuum distillation, thus saving on capital investment and operating costs as compared to conventional FCC processes that require a vacuum distillation unit. However, suitable feedstocks also include gas oil and vacuum gas oil.

An essential element in the process of the present invention is the circulation of low coke make solid particles of fluidizable particle size during the conversion of the hydrocarbon feedstock. Suitable low coke make solid particles preferably comprise a refractory inorganic oxide such as corundum, mullite, fused alumina, fused silica, alpha alumina, low-surface area calcined clays or the like. Regardless of which type of low coke make solid particles are selected, these particles must exhibit very little tendency to enhance the amount of coke deposited on the solids (catalyst plus low coke make solid particles) which are present in the reaction environment. Furthermore, it is essential that the low coke make solid particles possess a surface area of less than about 5 $m^2/g$ and preferably less than 1 $m^2/g$, and generate less than about 0.2 weight percent coke on the spent low coke make solid particles in the ASTM standard method for testing fluid cracking catalysts by microactivity test (MAT). If the additional solid particles were to contribute significantly to the formation of additional coke, then the additional heat release in the FCC regenerator would tend to inhibit the sought after regenerator temperature reduction. Similarly, the low surface area characteristic of the low coke make solid particles permits the rapid and complete stripping of hydrocarbonaceous reaction products from the low coke make solid particles in the reaction zone before the low coke make solid particles are transferred to the regeneration zone thereby preventing the combustible hydrocarbons from entering the regeneration zone and producing additional heat release. The low coke make solid particles must have no adverse effect upon the hydrocarbon conversion process, and be stable or resistant to physical breakdown due to the thermal and mechanical forces to which they are subjected in the process. The size of the low coke make solid particles may vary from about 5 to about 2000 microns and are preferably in the shape of spherical or spheroidal particles. In an embodiment of the present invention where an admixture of catalyst and low coke make solid particles is introduced to the hydrocarbon feedstock, the range of catalyst and low coke make particle size may, for example, be substantially the same, overlap, or be different. The apparent bulk density of the low coke make solid particles may vary from about 0.3 g/ml to about 4 g/ml.

Low coke make solids which are essential in the process of the present invention are those materials which have a coke deposit of 0.2 weight percent coke or less on the spent low coke make solid after the solid alone has been subjected to the ASTM standard method for testing cracking catalyst by microactivity test (MAT). This microactivity test is more formally known as the Standard Method for Testing Fluid Cracking Catalysts by Microactivity Test and is designated as test D 3907-80. This microactivity test is also mentioned in U.S. Pat. No. 4,493,902. The microactivity test is conducted in a laboratory test apparatus which is designed and operated in accordance with the Standard Method. Briefly, the microactivity test comprises loading a sample of particles weighing 4 grams into the reactor and injecting a standard batch of gas oil in an amount of 1.33 grams over a 75 second period into the reactor which is maintained at 900° F. The resulting particles to oil weight ratio is about 3 and the weight hourly space velocity is about 16. Then the conversion of the feedstock and the coke remaining on the spent particles may be determined by standard techniques.

The following discussion is not meant to be exhaustive but is presented to illustrate the primary advantage to be derived by the utilization of low coke make solid particles in the present invention. The circulation of the low coke make solid particles causes a significant reduction in the operating temperature of the regenerator beyond that which could be achieved if the catalyst is circulated without the low coke make solid particles. This feature of reduced regenerator temperature is of paramount importance to the hydrocarbon conversion industry since many of the currently popular FCC feedstocks contain significant quantities of non-distillable components which form coke and which coke ultimately must be removed from the circulating solid particles during regeneration. The combustion of high levels of carbon or coke during regeneration produces extraordinary quantities of heat which must be dissipated in some manner, since modern FCC catalysts are extremely sensitive to exposure to relatively high temperatures which exist in high temperature regenerators and this temperature sensitivity eventually leads to the degradation of a catalyst's activity and selectivity. Therefore, the resulting lower regenerator temperatures which are available in connection with the present invention help to maintain the cracking activity and selectivity of the catalyst and also provide increased flexibility in the choice of operating conditions. The circulation of low coke make solid particles also reduces the quantity of make-up catalyst required to maintain a given level of activity since the catalyst will maintain its activity longer.

Another essential element of the process of the present invention is a fluidizable FCC catalyst. In general, it is preferred to employ a catalyst having an effective level of cracking activity, providing high levels of conversion and productivity at low residence times. That catalyst may be introduced into the process in its virgin form or, in other than virgin form; e.g., equilibrium catalyst which has been previously used. One may employ any hydrocarbon cracking catalyst having the above-mentioned characteristics. A particularly preferred class of catalysts include those which have pore structures into which molecules of feed material may enter for adsorption and/or for contact with active catalytic sites within or adjacent the pores. Various types of catalysts are available within this classification, including for example the layered silicates, e.g., smectites. Although the most widely available catalysts within this classification are the well-known zeolite-containing catalysts, non-zeolite catalysts are also contemplated for the present invention as well. The preferred zeolite-containing catalysts may include any zeolite, whether natural, semi-synthetic, or synthetic, alone or in admixture with other materials which do not significantly impair the catalyst, provided the resultant catalyst has the activity and pore structure referred to above. For example, if the catalyst is a mixture, it may include the zeolite component associated with or dispersed in a porous refractory inorganic oxide carrier. In such a case, the catalyst may for example contain about 1% to about 60%, more preferably about 1% to about 40% and most preferably about 5% to about 25% by weight, based on the total weight of catalyst (water-free basis) of the zeolite, with the balance of the catalyst being the porous refractory inorganic oxide alone or in combination with any of the known adjuvants for promoting or suppressing various desired or undesired reactions. For a general explanation of the genus of zeolitic catalysts useful in the invention, attention is drawn to the disclosures of the articles entitled "Refinery Catalysts Are a Fluid Business" and "Making Cat Crackers Work on a Varied Diet," appearing respectively in the July 26, 1978 and Sept. 13, 1978 issues of *Chemical Week* magazine. The descriptions in the aforementioned publications are incorporated herein by reference. For the most part, the zeolite components of the zeolite-containing catalysts will be those which are known to be useful in FCC processes. In general, these are crystalline aluminosilicates, typically made up of tetra coordinated aluminum atoms associated through oxygen atoms with adjacent silicon atoms in the crystal structure. However, the term "zeolite" as used in this disclosure contemplates not only aluminosilicates, but also substances in which the aluminum has been partly or wholly replaced, such as for instance by gallium, phosphorus, and other metal atoms, and further includes substances in which all or part of the silicon has been replaced, such as for instance by germanium. Titanium and zirconium substitution may also be practical.

Most zeolites are prepared or occur naturally in the sodium form, so that sodium cations are associated with the electro negative sites in the crystal structure. The sodium cations tend to make zeolites inactive and much less stable when exposed to hydrocarbon conversion conditions, particularly high temperatures. Accordingly, the zeolite may be ion exchanged, and where the zeolite is a component of a catalyst composition, such ion exchanging may occur before or after incorporation of the zeolite as a component of the composition. Suitable cations for replacement of sodium in the zeolite crystal structure include ammonium (decomposable to hydrogen), hydrogen, rare earth metals, alkaline earth metals, etc. Various suitable ion exchange procedures and cations which may be exchanged into the zeolite crystal structure are well known to those skilled in the art.

Examples of the naturally occurring crystalline aluminosilicate zeolites which may be used as or included in the catalyst for the present invention are faujasite, mordenite, clinoptilote, chabazite, analycite, erionite, as well as levynite, dachiardite, paulingite, noselite, ferriorite, heulandite, scolccite, stibite, harmotome, phillipsite, brewsterite, flarite, datolite, gmelinite, caumnite, leucite, lazurite, scaplite, mesolite, ptholite, nepheline, matrolite, offretite and sodalite.

Examples of the synthetic crystalline aluminosilicate zeolites which are useful as or in the catalyst for carrying out the present invention are Zeolite X, U.S. Pat. No. 2,882,244; Zeolite Y, U.S. Pat. No. 3,130,007; and Zeolite A, U.S. Pat. No. 2,882,243; as well as Zeolite B, U.S. Pat. No. 3,008,308; Zeolite D, Canada Patent No. 661,981; Zeolite E, Canada Patent No. 614,495; Zeolite F, U.S. Pat. No. 2,996,358; Zeolite H, U.S. Pat. No. 3,010,789; Zeolite J, U.S. Pat. No. 3,001,869; Zeolite L, Belgian Patent No. 575,117; Zeolite M, U.S. Pat. No. 2,995,423; Zeolite O, U.S. Pat. No. 3,140,252; Zeolite Q, U.S. Pat. No. 2,991,151; Zeolite S, U.S. Pat. No. 3,054,657; Zeolite T, U.S. Pat. No. 2,950,952; Zeolite W, U.S. Pat. No. 3,012,853; Zeolite Z, Canada Patent No. 614,495; and Zeolite Omega, Canada Patent No. 817,915. Also, ZK-4HF, alpha beta and ZSM-type zeolites are useful. Moreover, the zeolites described in U.S. Pat. Nos. 3,140,249, 3,140,253, 3,944,482 and 4,137,151 are also useful, the disclosures of said patents being incorporated herein by reference.

The crystalline aluminosilicate zeolites having a faujasite-type crystal structure are particularly preferred for use in the present invention. This includes particularly natural faujasite and Zeolite X and Zeolite Y.

Commercial zeolite-containing catalysts are available with carriers containing a variety of metal oxides and combinations thereof, including for example silica, alumina, magnesia, and mixtures thereof and mixtures of such oxides with clays as e.g. described in U.S. Pat. No. 3,034,948. One may for example select any of the zeolite-containing molecular sieve fluid cracking catalysts which are suitable for production of gasoline from vacuum gas oils. However, certain advantages may be attained by judicious selection of catalysts having marked resistance to metals. A metal resistant zeolite catalyst is, for instance, described in U.S. Pat. No. 3,944,482, in which the catalyst contains 1–40 weight percent of a rare earth-exchanged zeolite, the balance being a refractory metal oxide having specified pore volume and size distribution.

In general, it is preferred to employ catalysts having an overall particle size in the range of about 5 to about 160 and more preferably about 30 to about 120 microns.

The catalyst composition may also include one or more combustion promoters which are useful in the subsequent step of regenerating the catalyst. Cracking of residual oils results in substantial deposition of coke on the catalyst, which coke reduces the activity of the catalyst. Thus, in order to restore the activity of the catalyst the coke is burned off in a regeneration step, in which the coke is converted to combustion gases including carbon monoxide and/or carbon dioxide. Various substances are known which, when incorporated in cracking catalyst in small quantities, tend to promote conversion of the coke to carbon dioxide. Such promoters, normally used in effective amounts ranging from a trace up to about 10 or 20% by weight of the catalyst, may be of any type which generally promotes combustion of carbon under regenerating conditions, or may be somewhat selective in respect to completing the combustion of CO.

In accordance with the present invention, a stream is formed comprising a suspension of hydrocarbon feedstock, catalyst and low coke make solid particles. The resulting suspension is conducted in a generally upward fashion to permit the desired hydrocarbon conversion to be performed. It is also foreseen that diluent streams, such as steam or light hydrocarbon gases, may also be introduced into the bottom of the reactor riser in order to maximize the degree of vaporization of the feed.

The apparatus for conducting the process of the present invention provides for rapidly vaporizing as much feed as possible and efficiently admixing the hydrocarbon feedstock, catalyst and low coke make solid particles thereby permitting the resultant mixture to flow as a dilute suspension in a progressive flow mode. At the end of a predetermined residence time, the catalyst and low coke make solid particles are separated from the hydrocarbons and it is preferred that all or at least a substantial portion of the hydrocarbons be abruptly separated from the catalyst and low coke make solid particles. This separation may be conducted in any convenient manner and may include the use of cyclones and the like. It is preferred that the suspension as hereinabove described be transported in what is referred to as a reactor riser which is situated in a nearly vertical position as opposed to the horizontal and have a length to diameter ratio of at least about 10, more preferably about 20 to 25 or more. If tubular, the reactor riser can be of uniform diameter throughout or may be provided with a continuous or step-wise increase in diameter along the reactor path to maintain or vary the velocity along the flow path. In general, the reactor configuration is such as to provide a relatively high velocity of flow and dilute suspension of catalyst and low coke make solid particles. For example, the average velocity in the reactor riser will usually be at least about 25 and more typically at least about 35 feet per second. This velocity may range up to about 55 or about 75 feet per second or higher. The velocity cpabilities of the riser will in general be sufficient to prevent substantial build-up of a catalyst bed in the bottom or other portions of the riser, whereby the catalyst loading in the riser can be maintained below about 4 or 5 pounds and below about 2 pounds per cubic foot, respectively, at the upstream (e.g. bottom) and downstream (e.g. top) ends of the riser.

The progressive flow mode involves, for example, flowing of catalyst, feed, low coke make solids and products as a stream in a positively controlled and maintained direction established by the elongated nature of the reaction zone. This is not to suggest however that there must be strictly linear flow. As is well known, turbulent flow and "slippage" of catalyst and low coke make solids may occur to some extent especially in certain ranges of vapor velocity and some catalyst loadings, although it has been reported advisable to employ sufficiently low catalyst loadings to restrict slippage and back-mixing. Most preferably the reactor is one which abruptly separates a substantial portion of all of the vaporized cracked products from the catalyst and low coke make solids at one or more points along the riser, and preferably separates substantially all of the vaporized cracked products from the catalyst and low coke make solids at the downstream end of the riser.

Preferred conditions for operation of the process of the present invention are described below. In our process it is preferred to restrict preheating of the feed so that the feed is capable of absorbing a larger amount of heat from the catalyst and low coke make solids while the catalyst and low coke make solids raise the feed to conversion temperature, at the same time minimizing utilization of external fuels to heat the feedstock. Thus, where the nature of the feedstock permits, it may be fed at ambient temperature while heavier feedstocks may be fed at preheat temperatures of up to about 600° F., typically about 200° F. to about 500° F., but higher preheat temperatures are not necessarily excluded. The catalyst and low coke make solid particles fed to the reactor riser may vary widely in temperature, for example from about 1100° to about 1700° F., more preferably about 1200° to about 1600° F.

The conversion of the hydrocarbon feedstock to lower molecular weight products may be conducted at a temperature of about 850° to about 1400° F. measured at the reactor vessel outlet. Depending upon the temperature selected and the properties of the feed, all of the feed may or may not vaporize in the reactor riser.

Although the pressure in the reactor vessel may range from about 10 to about 70 psia, a preferred range is from about 15 to about 55 psia. The residence time of feed and product vapors in the reactor riser may be in the range of about 0.5 to about 6 seconds. The residence time is dependent upon the feedstock, type and quantity of catalyst and low coke make solid particles, the temperature and pressure. One skilled in the hydrocarbon processing art will readily be able to select a suitable residence time in order to enjoy the benefits afforded by the present invention. It is preferred that the catalyst to oil ratios be maintained from about 1 to about 30 pounds of catalyst per pound of feedstock and that the low coke make solid particles be present in an amount sufficient to result in a ratio of low coke make solid particles to cracking catalyst from about 1:100 to about 10:1.

In general, the combination of catalyst to oil ratio, low coke make solids to oil ratio, temperatures, pressures and residence times should be such as to effect a substantial conversion of the residual hydrocarbon feedstock. It is an advantage of the process that very high levels of conversion can be attained in a single pass; for example, the conversion may be in excess of 60% and may range to about 90% or higher. Preferably, the aforementioned conditions are maintained at levels sufficient to maintain conversion levels in the range of about 60 to about 90% and more preferably about 65 to about 85%. The foregoing conversion levels are calculated by subtracting from 100% the percentage obtained by dividing the liquid volume of fresh feed into 100 times the volume of liquid product boiling at and above 430° F. These substantial levels of conversion may and usually do result in relatively large yields of coke, such as for example about 3.5 to about 20% by weight based on the fresh feed.

The present process preferably includes stripping of spent catalyst and low coke make solid particles after disengagement from the product vapors. Persons skilled in the art are acquainted with appropriate stripping agents and conditions for stripping spent catalyst.

Substantial conversion of hydrocarbon oil to ligher products in accordance with the invention tends to produce sufficiently large coke yields and coke laydown on the catalyst and low coke make solids to require some care in regeneration thereof. In order to maintain adequate activity in the catalyst, it is desirable to regenerate under conditions of time, temperature and atmosphere sufficient to reduce the percent by weight of carbon remaining on the catalyst to about 0.25% or less. The amounts of coke which must therefore be burned off in the regeneration zone when processing residual oils are substantial. Some coke will inevitably be deposited on the low coke make solid particles and the burning of this coke from the low coke make solid particles in the regeneration zone will herein be referred to as regeneration even though this burning is not an actual regeneration of catalytic activity. The term coke when used to describe the present invention, should be understood to include any non-vaporized hydrocarbons present on the catalyst and low coke make solids after stripping. Regeneration of the catalyst and low coke make solids by burning away of coke deposited on the catalyst and low coke make solids during the conversion of the feed may be performed at any suitable temperature in the range from about 1100° F. to about 1600° F. To ensure complete combustion of coke within the regenerator, a stream of hot catalyst from the regenerator may be transported to the regenerator inlet.

Heat released by combustion of coke in the regenerator is absorbed by the catalyst and the low coke make solid particles, and can be readily retained thereby until the regenerated mixture of solids are brought into contact with fresh feed. When processing residual hydrocarbon oil to the levels of conversion involved in one embodiment of the present invention, a substantial amount of heat is generated during coke burn-off in the regenerator. Heat requirements for the reactor include heating and vaporizing the feed, supplying the endothermic heat of reaction for cracking, and making up heat losses from the reactor. Heat from the regenerator is exported to the reactor via the circulation of the low coke make solid particles and catalyst. It is thus possible to control the regenerator temperature by varying the proportion of low coke make solids that are circulated between the regenerator and the reactor with the catalyst. This provides the opportunity to have independent control of the regenerator temperature by adjusting the quantity of low coke make solids in the circulating mixture of low coke make solids and catalyst.

Reference will now be made to the attached drawing for discussion of one embodiment of the present invention. A residual hydrocarbon feedstock enters into reactor riser 2 via conduit 1 and is contacted with an admixture of regenerated catalyst and low coke make solid particles which is supplied via conduit 13. The resulting combination of hydrocarbon, catalyst and low coke make solids travels in a generally upward fashion through reactor riser 2 wherein the majority of the hydrocarbon conversion occurs and enters reactor vessel 4 which has interior space 3. Interior space 3 serves as a disengagement area wherein the catalyst and the low coke make solids are separated from the hydrocarbon vapors. The spent catalyst and low coke make solids are collected in the bottom of reactor vessel 4 and subsequently removed therefrom via conduit 7. Level sensing, recording and control device 20 maintains the flow rate in conduit 7 based on the differentials in pressures measured by pressure sensitive devices 18 and 19. Variations in particle inventory in reactor vessel 4 will be reflected in a varying pressure differential. Control device 20 will then maintain a predetermined particle inventory by controlling control valve 21. The hydrocarbon vapors containing entrained fine particles of catalyst and low coke make solids are passed into cyclone separator 5 and the hydrocarbon vapors containing a reduced concentration of solids are removed from reactor vessel 4 via conduit 6. The disengaged solids are returned to interior space 3 from the bottom of cyclone separator 5. As is well known in the fluid cracking art, there may be a plurality of cyclone separators and the cyclones may be multistage, when the gas phase from a first stage cyclone discharging to a second stage cyclone.

The spent catalyst and low coke make solid particles are contacted via conduit 7 with regeneration air (or oxygen) supplied via conduit 8. The admixture of air, spent catalyst and low coke make solid particles is introduced into regenerator vessel 10 which has interior space 9 via conduit 8. Conditions within regeneration vessel 10 are such that oxygen containing air and coke combine chemically to produce flue gas while leaving the catalyst and the low coke make solid particles relatively free from coke. The resulting regenerated catalyst and low coke make solid particles are collected in a lower portion of regenerator vessel 10 and are subsequently removed via conduit 13 and introduced into reactor riser 2 as described hereinabove. Control valve 14 is located in conduit 13 to control the flow of regenerated catalyst and low coke make solid particles in response to a temperature measurement, and control means 15 receives and transmits the appropriate signals via means 16 and 17. Although temperature sensing means 16 is shown to be at the upper end of reactor vessel 4 near cyclone separator 5, any other suitable temperature associated with reactor vessel 4 may be selected to directly control valve 14. Flue gas exits regeneration vessel 10 via gas-catalyst separation means 11 and conduit 12.

The following discussion is presented in order to enable those skilled in the art to more fully understand the operation of the process of the present invention and to obtain the maximum benefits to be derived therefrom.

The following expression may be used to estimate the fluid catalytic cracker (FCC) regeneration zone or regenerator temperature which will result when low coke make solid particles with known specific heat and coke making tendencies are circulated from the regeneration zone to the reaction zone:

Final Regenerator Temperature = (A)(B)(C) + Reactor Temperature

The regenerator temperature predicted by the hereinabove equation assumes that all of the independent operating variables of the FCC unit are held constant, while the low coke make solid particles are added into the circulating catalyst inventory. These independent operating variables include feed temperature, feed composition, reactor temperature, extent of carbon monoxide combustion in the regeneration zone, plant pressure and catalyst type. For the purpose of these calculations, the only change which is allowed in the operation of the FCC unit is the addition of the low coke make solid particles to the circulating catalyst inventory.

By holding all of the independent operating variables constant, the influence of the low coke make solid particles in lowering the regeneration zone temperature can be more clearly seen. Of course, in commercial practice, once the regeneration zone temperature is reduced to a desired level, the hereinabove mentioned independent operating variables would normally be adjusted to take advantage of the reduced regeneration zone temperature.

The final regenerator temperature is a function of the quantity and specific heat of the low coke make solid particles, the specific heat of the FCC catalyst, the regenerator temperature before the addition of low coke make solid particles and the coke making tendency of the low coke make solid particles and the FCC catalyst.

In the hereinabove equation:

$$A = \frac{C_{pcatalyst}}{C_{pCatalyst}(1 - C_{LCMS}) + C_{PLCMS}(C_{LCMS})}$$

$$B = (T_{Regenerator\ Initial} - T_{Reactor})$$

$$C = \frac{D_{Catalyst}(1 - C_{LCMS}) + D_{LCMS}(C_{LCMS})}{D_{Catalyst}}$$

wherein $C_{LCMS}$ is defined as the weight fraction of the low coke make solid particles in the circulating FCC catalyst inventory after the addition of low coke make solid particles;

$Cp_{Catalyst}$ is defined as the specific heat of the catalyst;

$Cp_{LCMS}$ is defined as the specific heat of the low coke make solid particles;

$T_{Regenerator\ Initial}$ is defined as the FCC regenerator temperature before the addition of the low coke make solid particles;

$T_{Reactor}$ is defined as the FCC reactor dense phase temperature;

$D_{Catalyst}$ is defined as delta coke on the catalyst (weight percent coke on spent FCC catalyst particles minus the weight percent coke on the regenerated FCC catalyst particles); and $D_{LCMS}$ is defined as delta coke on the low coke make solid particles (weight percent coke on spent low coke make solid particles minus weight percent coke on the regenerated low coke make solid particles).

Examination of the "A" term presented hereinabove indicates that low coke make solid particles with high specific heats should be more effective since less material would be required to produce a given reduction in regenerator temperature. Note however, that even if the low coke make solid particles have a low specific heat, the process is still viable but more low coke make solid particles will be required to achieve the same effect.

The "C" term presented hereinabove indicates that low coke make solid particles which make little or no delta coke are more desirable since additional coke produced by the low coke make solid particles causes additional heat release in the FCC regenerator which tends to inhibit the sought after regenerator temperature reduction.

Since the FCC reactor's heat demand is virtually constant and the FCC unit operates in heat balance at constant operating conditions, any coke deposited on the low coke make solid particles will displace coke that formerly would have been generated by the circulation of FCC catalyst. As a consequence of this, coke deposited on the low coke make solid particles will tend to reduce the number of catalyst particles delivered to the riser per pound of feed as defined as the catalyst to oil ratio. Thus the conversion observed in the FCC reactor will decrease. This is a strong incentive to select low coke make solid particles which make little or no coke in order to have the least detrimental impact on the performance of the FCC reactor.

The following examples are presented in illustration of preferred embodiments of the present invention and are not intended to be an undue limitation on the generally broad scope of the invention as set out in the appended claims.

EXAMPLE I

Tests were conducted in a commercial fluid catalytic cracking plant to illustrate the advantages of the present invention. The tests were based upon cracking a blend of vacuum gas oil and atmospheric resid. Both the vacuum gas oil and the atmospheric resid were derived from a domestic crude oil and the blend contained 8.4 liquid volume percent atmospheric resid. An analysis of these feed components is presented in Table 1.

TABLE 1

FEED STOCK ANALYSIS

| | Vacuum Gas Oil | Atmospheric Resid |
|---|---|---|
| Gravity, °API | 25.8 | 16.5 |
| Sulfer, weight percent | 0.93 | 1.49 |
| Conradson Carbon, weight percent | 0.29 | 8.5 |
| Nickel Plus Vanadium, PPM | 0.2 | 34 |
| Distillation | | |
| I.B.P., °F. | 540 | 675 |
| 5% | 635 | 800 |
| 20 | 690 | 890 |
| 40 | 752 | 980 |
| 60 | 835 | 1065 @ 57% |
| 80 | 932 | |
| 95 | 1040 | |
| E.P., °F. | 1076 | |
| % Recovered | 99 | 57 |
| % Bottoms | 1 | 43 |

The tests were conducted in an upflow riser with a zeolite fluid cracking catalyst. The operating conditions of both tests include a reactor pressure of 18 psig. The first test was conducted as a base case and is representative of a conventional FCC unit processing a feedstock comprising atmospheric resid. This test was conducted at a catalyst to oil ratio of 6.5, a feed temperature of 441° F., and a reactor temperature of 972° F. with a resulting regenerator temperature of 1368° F. The fresh feed conversion was 81.7 liquid volume percent while producing gasoline in an amount of 62.5 liquid volume percent and having a research octane number of 92.7. The coke yield was 5.6 weight percent of the feed.

The second test was conducted as a comparative case and is illustrative of one embodiment of the present invention. This test was conducted with the same feedstock comprising atmospheric resid as the first test. This test was conducted at a catalyst to oil ratio of 6.5, a feed temperature of 475° F. and reactor temperature of 970° F. In this test, the circulating catalyst stream to the reactor also contained low coke make inorganic oxide solid particles in an amount of 9 weight parts catalyst to one weight part low coke make solids or a catalyst to low coke make solids ratio of nine. The low coke make inorganic oxide solid particles used in this test were alpha alumina particles which possessed a surface area of less than about 1 $m^2/g$ and which particles generate 0 weight percent carbon on the spent alpha alumina in the ASTM standard method for testing fluid cracking catalyst by microactivity test (MAT). The resulting solids (catalyst plus low coke make solid particles) to oil ratio was therefore 7.5. The regenerator temperature was found to be only 1337° F. as compared to 1368° F. for the first test. The feed conversion was 80.5 liquid volume percent while producing gasoline in an amount of 62.7 liquid volume percent and having a research octane number of 92.5. The coke yield was 5.6 weight percent. It will be noted that the temperature of the feed in the second test as 475° F. while the feed temperature in the first test was 441° F. or 34° f. less. It is well known for this type of FCC operation that an increase in the feed temperature causes an increase in the regenerator temperature. Therefore, with a lower feed temperature in the second test, a correspondingly lower regenerator temperature would have been expected which would have demonstrated an even greater reduction in the regenerator temperature. The results of both tests are presented for ease of comparison in Table 2.

TABLE 2

TEST SUMMARY

| Operating Conditions | | |
|---|---|---|
| Configuration | Conventional | Catalyst/LCM Solids |
| Catalyst/LCM Solids, Weight Percent | 100/0 | 90/10 |
| Feed Temperature, °F. | 441 | 475 |
| Reactor Pressure, PSIG | 18 | 18 |
| Reactor Temperature, °F. | 972 | 970 |
| Catalyst/Oil Ratio, LB/LB | 6.7 | 6.7 |
| Total Solids/Oil Ratio, LB/LB | 6.7 | 7.5 |
| Catalyst/LCM Solids Ratio, LB/LB | — | 9 |
| Regenerator Temperature, °F. | 1368 | 1337 |
| Product Distribution | | |
| $C_2$—, Wt. % | 4.1 | 4.0 |
| $C_3$, Liquid Volume % | 12.7 | 12.2 |
| $C_4$, Liquid Volume % | 15.6 | 14.8 |
| Gasoline, Liquid Volume % | 62.5 | 62.7 |
| Light Cycle Oil, Liquid Volume % | 11.1 | 12.4 |
| Clarified Slurry Oil, Liquid Volume % | 7.2 | 7.1 |
| Coke Yield, Wt. % | 5.6 | 5.6 |
| Total Yield, Liquid Volume % | 109.1 | 109.2 |
| Weight Percent Coke on Solids | 0.85 | 0.76 |
| Conversion, Liquid Volume % | 81.7 | 80.5 |
| Gasoline Research Octane Number | 92.7 | 92.5 |

The above comparison demonstrates that the use of low coke make solid particles with the cracking catalyst produced the same amount of coke as the catalyst alone produced. The conversion and product yields are comparable for both tests. From the operational standpoint, the extraordinary advantage demonstrated by the low coke make solids addition test was the ability to operate the catalyst regenerator at 1337° F. or 31° F. less than the base or control case.

As mentioned hereinabove, the resulting lower regenerator temperature helps to maintain the cracking activity of the catalyst, provides increased flexibility in the choice of operating conditions and eliminates, or at least reduces, the requirement to provide external cooling facilities for the catalyst regenerator. The temperature of the regenerator may also be controlled independently by varying the proportion of low coke make solids in the catalyst plus low coke make solids mixture.

EXAMPLE II

This example is presented to show the results of the testing of a variety of fluidizable solid particles in a test which is considered to be essentially equivalent to the hereinabove described ASTM standard method for testing cracking catalyst by microactivity test (MAT). The test utilized in this example used a feed whch was a heart-cut gas oil from a Mid-Continent crude which gas oil had the properties presented in Table 3.

TABLE 3

| Mid-Continent Gas Oil Properties | |
|---|---|
| Gravity, °API at 60° F. | 31.8 |
| Sulfur, Wt. % | 0.26 |
| Nitrogen, Wt. % | 0.03 |
| Heavy Metals, ppm | 3 |
| Distillation | |
| IBP, °F. | 458 |
| 20% | 581 |
| 50% | 660 |
| 70% | 703 |
| 95% | 775 |
| E.P., °F. | 810 |

The hereinabove described gas oil feed which was used in this example was similar to, but not identical to, the ASTM standard feed referred to in the ASTM standard procedure and was selected in an attempt to duplicate the ASTM standard feed.

The present test comprises loading a sample of particles weighing 4 grams into the reactor and injecting the hereinabove described gas oil in an amount of 1.3 grams over a 75 second period into the reactor which is maintained at 900° F. The resulting particles to oil weight ratio is about 3 and the weight hourly space velocity is about 15.4.

Samples of alpha-alumina particles, gamma-alumina particles and calcined kaolin clay particles were separately tested in the hereinabove described test. Characteristics of these three materials and the results of the separate tests are presented in Table 4.

TABLE 4

Test Results

| | BET Surface Area, $M^2/G$ | Pore Volume, cc/g | Conversion Vol. % | Coke on Spent Solids Wt. % |
|---|---|---|---|---|
| alpha-alumina | <1 | 0 | 4.1 | 0 |
| gamma-alumina | 205 | 0.92 | 7.3 | 0.32 |
| calcined kaolin clay (3 hours at 1600° F.) | 9 | 0.0154 | 6.6 | 0.08 |

The gamma-alumina which was tested is representative of the alumina having a surface area of 30–1000 $m^2/g$ and a pore volume of 0.05–2.5 cc/g and which is taught as a diluent for catalytic cracking catalyst in British Pat. No. 2,116,062 (Occelli, et al.). The data from Table 4 show that gamma-alumina demonstrates a conversion of 7.3 volume percent, accumulates 0.32 weight percent coke on the spent gamma-alumina particles and has a surface area of 205 $m^2/g$. In accordance with the present invention, the particles selected to perform the function of low coke make solid particles must necessarily produce less than about 0.2 weight percent coke on the spent particles in the ASTM standard method for testing cracking catalyst by microactivity test (MAT), have a surface area of less than about 5 $m^2/g$ and not substantially affect the operation of the reaction zone. Therefore, since the gamma-alumina accumulated a relatively substantial amount of coke and had a propensity to convert hydrocarbons thereby having the undesirable ability to affect the operation of an FCC reaction zone, gamma-alumina is not a satisfactory candidate for use as the low coke make solid particles in the present invention.

The calcined kaolin clay which was tested as hereinabove described is believed to be representative of the calcined kaolin clay which is taught as a large pore inert material to be added with active catalyst in U.S. Pat. No. 4,289,605 (Bartholic). The data from Table 4 show that calcined kaolin clay demonstrates a conversion of 6.6 volume percent, accumulates 0.08 weight percent coke on the spent kaolin clay particles and has a surface area of 9 $m^2/g$. In accordance with the present invention, the particles selected to perform the function of low coke make solid particles must necessarily produce less than about 0.2 weight percent coke on the spent particles in the ASTM standard method for testing cracking catalyst by microactivity test (MAT), have a surface area of less than about 5 $m^2/g$ and not substantially affect the operation of the reaction zone. Therefore, since the calcined kaolin clay accumulated measurable coke, had a propensity to convert hydrocarbons thereby also having the undesirable ability to affect the operation of an FCC reaction zone and had a surface area of 9 $m^2/g$, the calcined kaolin clay, as tested, is not considered to be a satisfactory candidate for use as the low coke make solid particles in the present invention.

In accordance with the present invention, preferred low coke make particles are fluidizable alpha-alumina particles. The data from Table 4 show that alpha-alumina demonstrates what is considered a minimal conversion of 4.1 volume percent, accumulates no detectable coke on the spent alpha-alumina in the ASTM standard method for testing fluid catalytic cracking catalyst by microactivity test and has a surface area of less than 1 $m^2/g$. In order to enjoy the maximum benefits from the process of the present invention it is preferable that the fluidizable low coke make solid particles have a surface area of less than about 5 $m^2/g$ and generate less than about 0.2 weight percent coke on the spent low coke make solid particles in the ASTM standard method for testing fluid cracking catalyst by microactivity test (MAT). Fluidizable low coke make solid particles which generate substantially less than 0.2 weight percent coke on the spent low coke make solid particles in the ASTM standard method for testing fluid cracking catalyst by microactivity test (MAT) are even more preferred. Most preferred low coke make solid particles have a surface area of less than about 5 $m^2/g$ and generate less than about 0.05 weight percent coke on the spent low coke make solid particles in the ASTM standard method for testing fluid cracking catalyst by microactivity test (MAT).

The foregoing description and examples clearly illustrate the improvements encompassed by the present invention and the benefits to be afforded with the use thereof.

We claim as our invention:

1. A method for operating a fluid catalytic cracking unit comprising a regeneration zone and a reaction zone with a relatively reduced temperature in said regeneration zone while processing a hydrocarbon feedstock with 50 volume percent of said feedstock having a boiling point temperature greater than about 500° F. which method comprises:

(a) contacting said feedstock in said reaction zone with a solids mixture of regenerated fluidizable cracking catalyst and fluidizable low coke make solid particles comprising alpha-alumina in a ratio of said low coke make solid particles to said cracking catalyst from about 1:100 to about 10:1, said low coke make solid particles having a surface area of less than 1 $m^2/g$, a pore volume of 0 cc/g and a coke making capability of less than about 0.05 weight percent coke on the spent low coke make solid particles in the ASTM standard method for testing cracking catalyst by microactivity test (MAT), said contacting occurring under cracking conditions sufficient to result in a feedstock conversion level ranging from about 60 to 90 volume percent;

(b) separating the resulting converted hydrocarbon products from the mixture of deactivated fluidizable cracking catalyst and fluidizable low coke make solid particles;

(c) recovering said resulting converted hydrocarbon products;

(d) passing said mixture of cracking catalyst and low coke make solid particles to said regeneration zone for regeneration by removal of coke; and (e) passing the resulting regenerated mixture of cracking catalyst and low coke make solid particles from said regeneration zone to said reaction zone to contact said feedstock as described in step (a) with the amount of low coke make solids present in said solids mixture being sufficient to maintain the temperature of said regenerated cracking catalyst below 1600° F. in said regeneration zone and to maintain the temperature in said regeneration zone between 10° to 250° F. less than would otherwise be expected when an equal amount of solids were present in said regeneration zone comprised of said cracking catalyst without the additional presence of said low coke make solids while simultaneously not affecting the operation of said reaction zone.

2. The method of claim 1 wherein said catalyst has an overall particle size in the range from about 5 to about 160 microns.

3. The method of claim 1 wherein said low coke make solid particles have an overall particle size in the range from about 5 to about 2000 microns.

4. The method of claim 1 wherein said low coke make solid particles are fed to said reaction zone at a temperature from about 1200° F. to about 1600° F.

5. The method of claim 1 wherein said reaction zone is operated at a pressure from about 15 psia to about 55 psia.

6. The method of claim 1 wherein said catalyst is supplied at a catalyst to feedstock ratio from about 1 to about 30 pounds of catalyst per pound of feedstock.

7. The method of claim 1 wherein the reaction zone is operated at a temperature from about 850° F. to about 1400° F.

8. The method of claim 1 wherein said hydrocarbon feedstock comprises a reduced crude boiling at or above 650° F.

9. The method of claim 8 wherein said hydrocarbon feedstock comprises a reduced crude in admixture with a virgin gas oil.

10. The method of claim 1 wherein said level of conversion ranges from 65 to 85 volume percent.

11. In a process for fluid catalytic cracking of a hydrocarbon feedstock with 50 volume percent of said feedstock having a boiling point temperature greater than about 500° F. by contacting the feedstock at cracking conditions sufficient to result in a conversion level of said feedstock in the range of from about 60 to 90 volume percent with a circulating, particle form, solid cracking catalyst whereby components of the feedstock are converted to lower boiling hydrocarbons in a reaction zone with concurrent deposition on the catalyst of a deactivating carbonaceous contaminant, regenerating the catalytic cracking activity of the contaminated catalyst by burning carbonaceous deposits therefrom in a regeneration zone and under conditions that would otherwise result in the regeneration zone reaching an unacceptable or undesired maximum temperature condition, circulating catalyst so regenerated from the regeneration zone to the reaction zone, wherein the improvement comprises reducing the maximum temperature reached in the regeneration zone without reducing the amount of coke burned therein by simultaneously circulating, in admixture with the cracking catalyst, fluidizable low coke make solid particles which comprise alpha-alumina and have a surface area of less than 1 $m^2/g$, a pore volume of 0 cc/g and which low coke make solid particles generate less than about 0.05 weight percent coke on the spent low coke make solid particles in the ASTM standard method for testing fluid cracking catalysts by microactivity test (MAT) in an amount sufficient to result in a ratio of said low coke make solid particles to said cracking catalyst from about 1:100 to about 10:1, with the amount of said low coke make solids present in said solids mixture being sufficient to maintain the temperature of said regenerated cracking catalyst below 1600° F. in said regeneration zone and to maintain the temperature in said regeneration zone between 10° to 250° F. less than would otherwise be expected when an equal amount of solids were present in said regeneration zone comprised of said cracking catalyst without the additional presence of said low coke make solids while simultaneously not affecting the operation of the reaction zone.

12. The process of claim 11 wherein said catalyst has an overall particle size in the range from about 5 to about 160 microns.

13. The process of claim 11 wherein said low coke make solid particles have an overall particle size in the range from about 5 to about 2000 microns.

14. The process of claim 11 wherein said low coke make solid particles are fed to said reaction zone at a temperature from about 1200° F. to about 1600° F.

15. The process of claim 11 wherein said reaction zone is operated at a pressure from about 15 psia to bout 55 psia.

16. The process of claim 11 wherein said catalyst is supplied at catalyst to feedstock ratio from about 1 to about 30 pounds of catalyst per pound of feedstock.

17. The process of claim 11 wherein the reaction zone is operated at a temperature from about 850° F. to about 1400° F.

18. The method of claim 11 wherein said hydrocarbon feedstock comprises a reduced crude boiling at or above 650° F.

19. The method of claim 18 wherein said hydrocarbon feedstock comprises a reduced crude in admixture with a virgin gas oil.

20. The method of claim 11 wherein said level of conversion ranges from 65 to 85 volume percent.

* * * * *